US009287080B2

(12) United States Patent
Filippychev

(10) Patent No.: US 9,287,080 B2
(45) Date of Patent: Mar. 15, 2016

(54) METHOD AND SYSTEM FOR A PIEZOELECTRIC HIGH VOLTAGE X-RAY SOURCE

(71) Applicant: Bruker AXS Handheld, Inc., Kennewick, WA (US)

(72) Inventor: Sergey Arkadyevich Filippychev, Richland, WA (US)

(73) Assignee: BRUKER AXS HANDHELD, INC., Kennewick, WA (US)

( * ) Notice: Subject to any disclaimer, the term of this patent is extended or adjusted under 35 U.S.C. 154(b) by 107 days.

(21) Appl. No.: 14/296,586

(22) Filed: Jun. 5, 2014

(65) Prior Publication Data

US 2015/0357149 A1 Dec. 10, 2015

(51) Int. Cl.

| | |
|---|---|
| ***H01J 35/06*** | (2006.01) |
| ***H01J 35/16*** | (2006.01) |
| ***H01J 35/18*** | (2006.01) |

(52) U.S. Cl.

CPC ..... *H01J 35/16* (2013.01); *H01J 35/18* (2013.01); *H01J 2235/10* (2013.01); *H01J 2235/163* (2013.01); *H01J 2235/186* (2013.01)

(58) Field of Classification Search

CPC ..... H01J 35/14; H01J 35/16; H01J 35/18; H01J 2235/186; H01J 2235/10

USPC ..... 378/119, 121, 136, 137, 138, 140

See application file for complete search history.

(56) References Cited

U.S. PATENT DOCUMENTS

| | | | | |
|---|---|---|---|---|
| 6,111,933 | A | 8/2000 | Schaaf et al. | |
| 7,741,615 | B2 | 6/2010 | Putterman et al. | |
| 2004/0028183 | A1* | 2/2004 | Lu | A61B 6/4021 378/109 |

OTHER PUBLICATIONS

Gall, B. et al., "Investigation of the Piezoelectric Effect as a Means to Generate X-Rays," IEEE Transactions on Plasma Science, vol. 41, No. 1, Jan. 2013, pp. 106-111.

Staines, G. et al., "Compact Piezo-Based High Voltage Generator—Part I: Quasi-Static Measurements," Electromagnetic Phenomena, vol. 3, No. 3 (11), 2003, pp. 373-383.

* cited by examiner

*Primary Examiner* — Courtney Thomas
(74) *Attorney, Agent, or Firm* — Armstrong Teasdale LLP

(57) ABSTRACT

A system and method for generating X-rays are provided. The X-ray source includes an X-ray chamber including a sidewall formed of a piezoelectric material at least partially surrounding an evacuated chamber, a cathode positioned at a first end of the evacuated chamber, an anode positioned at a second opposite end of the evacuated chamber, and a window positioned at the second end, the window substantially transparent to X-ray radiation. The window includes a target layer at least partially covering a surface of the window. The target layer is configured to receive a flow of electrons from the cathode and to generate a flow of X-rays from an interaction with the flow of electrons. The X-ray source includes an actuator coaxially aligned with the X-ray chamber and configured to generate a stress in the sidewall.

20 Claims, 4 Drawing Sheets

METHOD AND SYSTEM FOR A PIEZOELECTRIC HIGH VOLTAGE X-RAY SOURCE

BACKGROUND

This description relates to X-ray generators, and, more particularly, to a method and system for a high voltage piezoelectric generator and X-ray source combination.

At least some known X-ray generators use a high voltage power supply to provide a stream of electrons, which are accelerated toward a target material. The accelerated electrons interact with the target material to generate a stream of X-rays, which exit the X-ray generator to be used by a process. The high voltage is typically supplied by a high voltage power supply connected to the X-ray generator via an electrical cable. Moreover, the high voltage components of the X-ray generator require additional space or insulators to accommodate the high voltage. Such considerations increase the size and weight of typical X-ray generators such that they prevent further miniaturization.

BRIEF DESCRIPTION

In one aspect, an X-ray source includes an X-ray chamber including a sidewall formed of a piezoelectric material at least partially surrounding an evacuated chamber, a cathode positioned at a first end of the evacuated chamber, an anode positioned at a second opposite end of the evacuated chamber, and a window positioned at the second end, the window substantially transparent to X-ray radiation. The window includes a target layer at least partially covering a surface of the window. The target layer is configured to receive a flow of electrons from the cathode and to generate a flow of X-rays from an interaction with the flow of electrons. The X-ray source includes an actuator coaxially aligned with the X-ray chamber and configured to generate a stress in the sidewall.

In another aspect, a method of generating X-rays includes applying a force to a piezoelectric sidewall of an X-ray chamber, generating an electric field in the piezoelectric sidewall relative to the applied force, and generating a flow of electrons from a cathode of the X-ray chamber. The method also includes accelerating the flow of electrons towards a target, and generating a flow of X-rays from the target using electrons from the flow of electrons that interact with the target.

In yet another aspect, an X-ray generating system includes a housing including a pistol-grip configured to receive a hand of a user and an X-ray generator positioned at least partially within the housing. The X-ray generator includes a sidewall formed of piezoelectric material, the sidewall configured to generate electric charge in response to a stress applied to the sidewall, a cathode configured to concentrate the charge at a first end of the sidewall, and a target assembly positioned at a second opposite end of the sidewall. The target assembly includes a target window, a target material deposited on the target window, and an anode positioned adjacent the target window. The anode is configured to accelerate a flow of electrons from the cathode toward the target material. The X-ray generating system an actuator configured to generate a stress in the sidewall.

BRIEF DESCRIPTION OF THE DRAWINGS

FIG. 1 is a side elevation view of an X-ray generator in accordance with an example embodiment of the present disclosure.

FIG. 2 is a side elevation view of an X-ray generator in accordance with another example embodiment of the present disclosure.

FIG. 3 is a side elevation view of an X-ray generator in accordance with another example embodiment of the present disclosure.

FIG. 4 is a flow diagram of a method of generating a flow of X-rays.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to analytical and methodical embodiments of generating X-rays in a portable hand-held X-ray generator in industrial, commercial, and residential applications.

The following description refers to the accompanying drawings, in which, in the absence of a contrary representation, the same numbers in different drawings represent similar elements.

Figure 1:
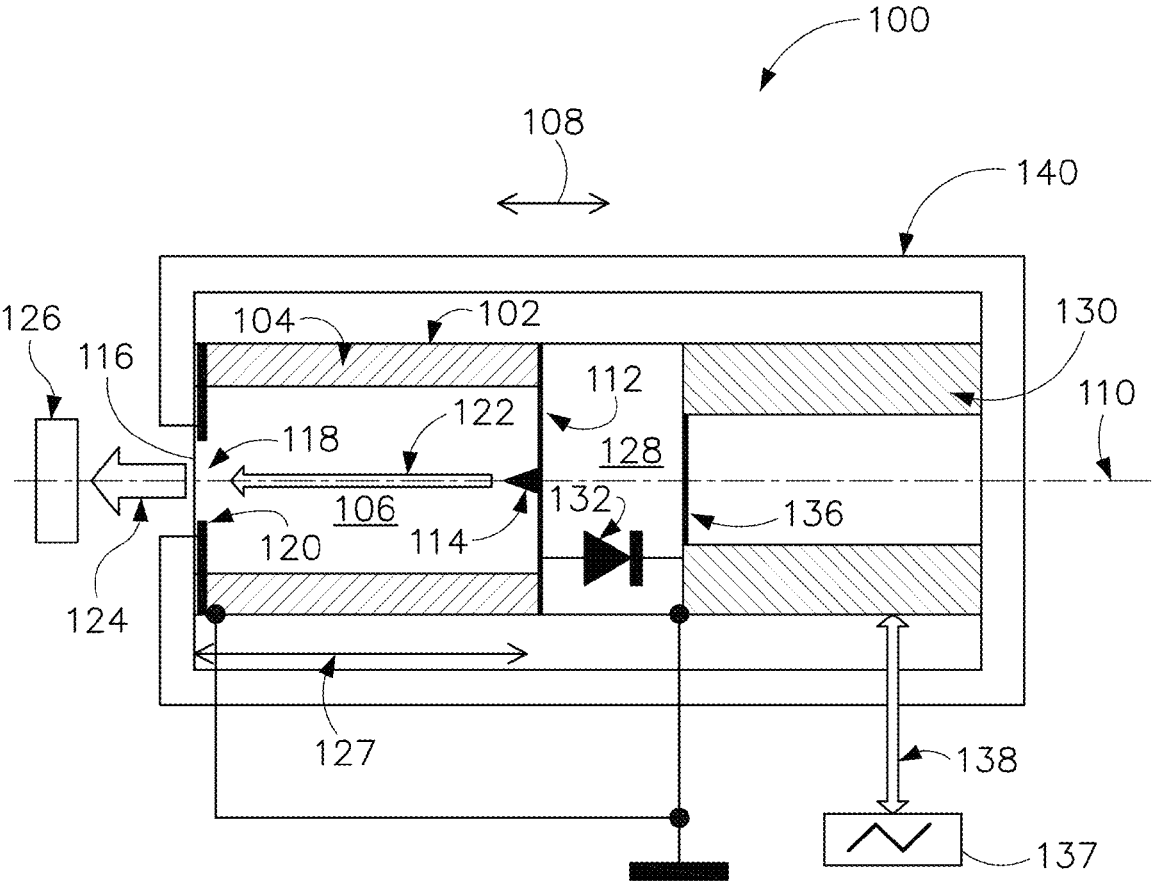
FIGS. 1-4 show example embodiments of the method and apparatus described herein.

FIG. 1 is a side elevation view of an X-ray generator 100 in accordance with an example embodiment of the present disclosure. In the example embodiment, a cylindrical shaped X-ray chamber 102 includes a sidewall 104 that surrounds an evacuated volume 106. Sidewall 104 is formed of a piezoelectric material sensitive to a compressive force applied in an axial direction 108 along a longitudinal axis 110 of X-ray generator 100. The compressive force exerted over an area of an end face 111 of sidewall 104 defines a stress in sidewall 104.

X-ray chamber 102 includes a cathode 112 enclosing a first end of X-ray chamber 102. Cathode 112 includes a generally planar cross-section and a charge concentrator 114 extending from a first face 115 of cathode 112. In the example embodiment, charge concentrator 114 includes a triangular cross-section with an apex of the triangle extending farthest into volume 106. A second opposite end of X-ray chamber 102 is enclosed by a window 116 formed of, for example, but, not limited to, beryllium. A target material 118, such as, but, not limited to silver, rhodium, copper, tungsten, or combinations thereof, is deposited onto window 116 by, for example, a sputtering process. An anode 120 is positioned within evacuated volume 106 adjacent window 116.

During operation, a compressive force, typically in the form of an impulse or series of impulses is applied axially to sidewall 104. The compressive force impulses cause the piezoelectric material of sidewall 104 to generate an electrostatic charge proportional to the stress exerted on sidewall 104 due to the input force. The electrostatic charge accumulates on charge concentrator 114 until the charge reaches a dielectric breakdown potential. A stream or burst of electrons 122 are then emitted from charge concentrator 114 and are accelerated towards anode 120. A large number of electrons 122 strike target material 118 with enough energy to generate X-rays 124, which continue outwardly from X-ray chamber 102 towards a sample material 126.

Piezoelectric ceramic under stress generates an electrical charge proportional to the applied stress, this charge accumulates on the outer electrodes to build up a voltage proportional to the stress and inversely proportional to capacitance between the electrodes. The voltage or electrical potential E can be found from equation (1):

$$E=L\cdot g_{33}\cdot\sigma, \quad (1)$$

where

E-Voltage potential between anode and cathode (V),

L—Piezoelectric Ceramic Length (m), g33—Piezoelectric material constant (V·m/N), and σ—Stress in Piezoelectric Ceramic ($N/m^2$).

In an example: if, L=0.04 m, $g33=25\times10^{-3}$ V·m/N and $\sigma=1/6\cdot amax=100\times10^6$ $N/m^2$, E will be approximately 100 kV. Other combinations of the length of sidewall 104, the piezoelectric constant of the material of sidewall 10, and the amount of stress applied to sidewall 104 will provide other voltage output levels for sidewall 104. The stress applied to sidewall 104 is controllable to provide a selectable output level. In various embodiments, a length 127 of sidewall 104 and the piezoelectric constant are selected to provide an output potential of between approximately 80 kV and approximately 120 kV with a stress applied that does not damage sidewall 104. Stress in piezoelectric ceramic has limits and beyond those limits, the material will fracture. Due to the nature of the exemplary material, tensile and compression stress limits differ by about 18-20 times. Average tensile stress is $15\text{-}20\times10^6$ $N/m^2$ and compression stress is about $100\text{-}600\times10^6$ $N/m^2$.

The force is applied to sidewall 104 through an insulator 128 from an actuator 130. In the example embodiment, insulator 128 is cylindrical about axis 110 and axially aligned with X-ray chamber 102. Insulator 128 is formed of an insulative material that is also capable of transferring a compressive force from actuator 130 to sidewall 104. In the example embodiment, insulator 128 is formed of alumina, for example, but not limited to $Al_2O_3$, $Al_3O_2$. A diode 132 facilitates recovering the potential across insulator 128. In the example embodiment, diode 132 is illustrated in close proximity to insulator 128, such as, positioned in a channel formed in insulator 128. In various embodiments, diode 132 is positioned remotely from insulator 128 and coupled electrically between cathode 112 and a ground electrode 136 positioned between actuator 130 and insulator 128.

In the example embodiment, actuator 130 is embodied in a second piezoelectric ceramic material formed as a cylinder. An electrical source 137 is electrically coupled to actuator 130 through a conduit 138. In one embodiment, electrical source 137 supplies electrical energy to actuator 130. Actuator 130 deforms under the influence of the electrical energy to press on sidewall 104 through insulator 128. In various embodiments, electrical source 137 supplies the electrical energy at approximately 150 volts to approximately 200 volts. In other embodiments, electrical source 137 supplies the electrical energy at approximately 75 volts to approximately 300 volts. In still other embodiments, electrical source 137 supplies the electrical energy at approximately 48 volts to approximately 440 volts. In various embodiments, electrical source 137 supplies the electrical energy at approximately 800 Hz to approximately 20 kHz. In other embodiments, electrical source 137 supplies the electrical energy at approximately 500 Hz to approximately 30 kHz. In still other embodiments, electrical source 137 supplies the electrical energy at approximately 200 Hz to approximately 40 kHz. In various embodiments, a frequency of the applied force is selected to coincide with a resonant frequency of X-ray generator 100.

In various embodiments, actuator 130 is other than a piezoelectric material. For example, actuator 130 is any device that can impart an axial force into sidewall 104. Actuator 130 can be, for example, but not limited to an electric linear motor, mechanical oscillator, or other electrical device that converts electrical energy into motion or a force. Actuator 130 can also be pneumatic, hydraulic, or mechanical. In one embodiment, actuator 130 is a trigger-activated bias member that provides an impulse or series of impulses after the bias member has charged to a predetermined amount.

A rigid outer shell 140 surrounds X-ray chamber 102, insulator 128, and actuator 130. In the example embodiment, outer shell 140 is formed of a ceramic material. In various embodiments, outer shell 140 is formed of a metallic material.

Figure 2:
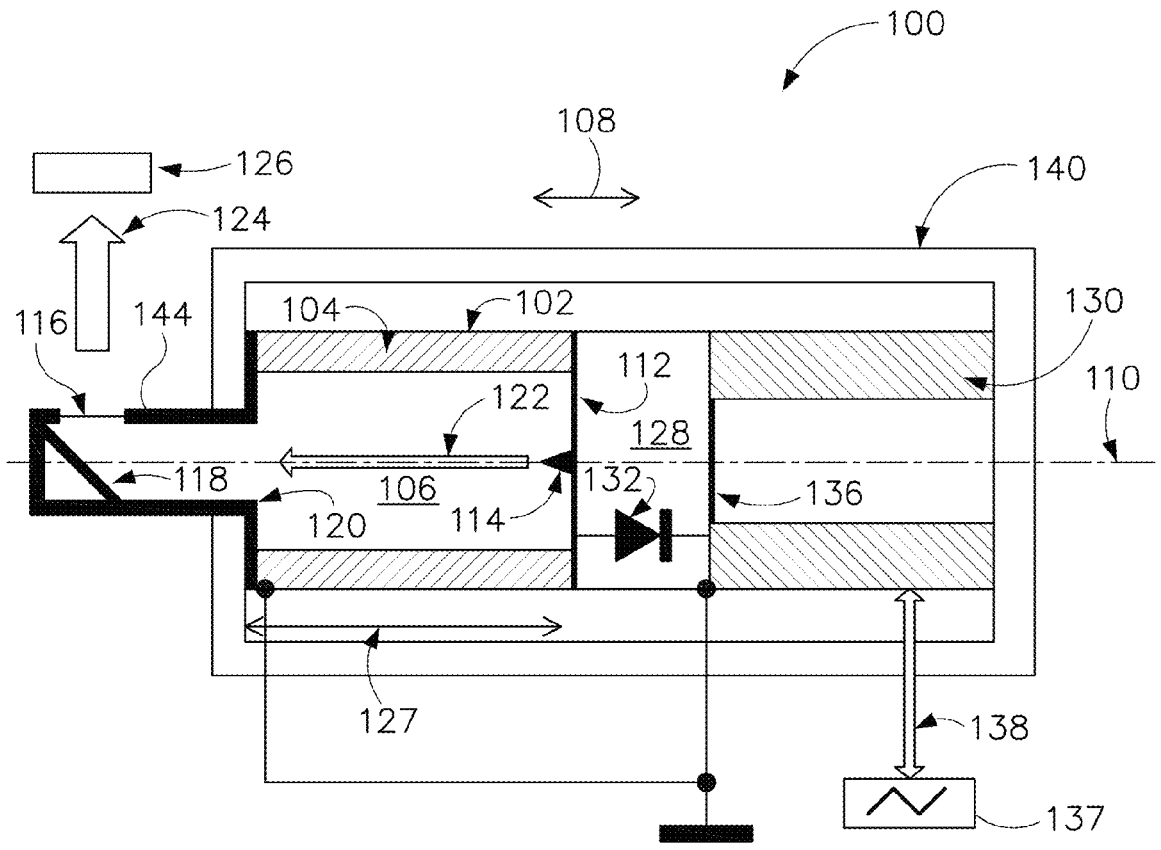

FIG. 2 is a side elevation view of an X-ray generator 100 in accordance with another example embodiment of the present disclosure. In the example embodiment, anode 120 includes a cylindrical axially extending portion 142 that accelerates stream of electrons 122 towards target material 118, which in this embodiment is angled with respect to longitudinal axis 110. In the example embodiment, window 116 is positioned radially outward from target material 118 in a sidewall 144 of anode 120.

Figure 3:
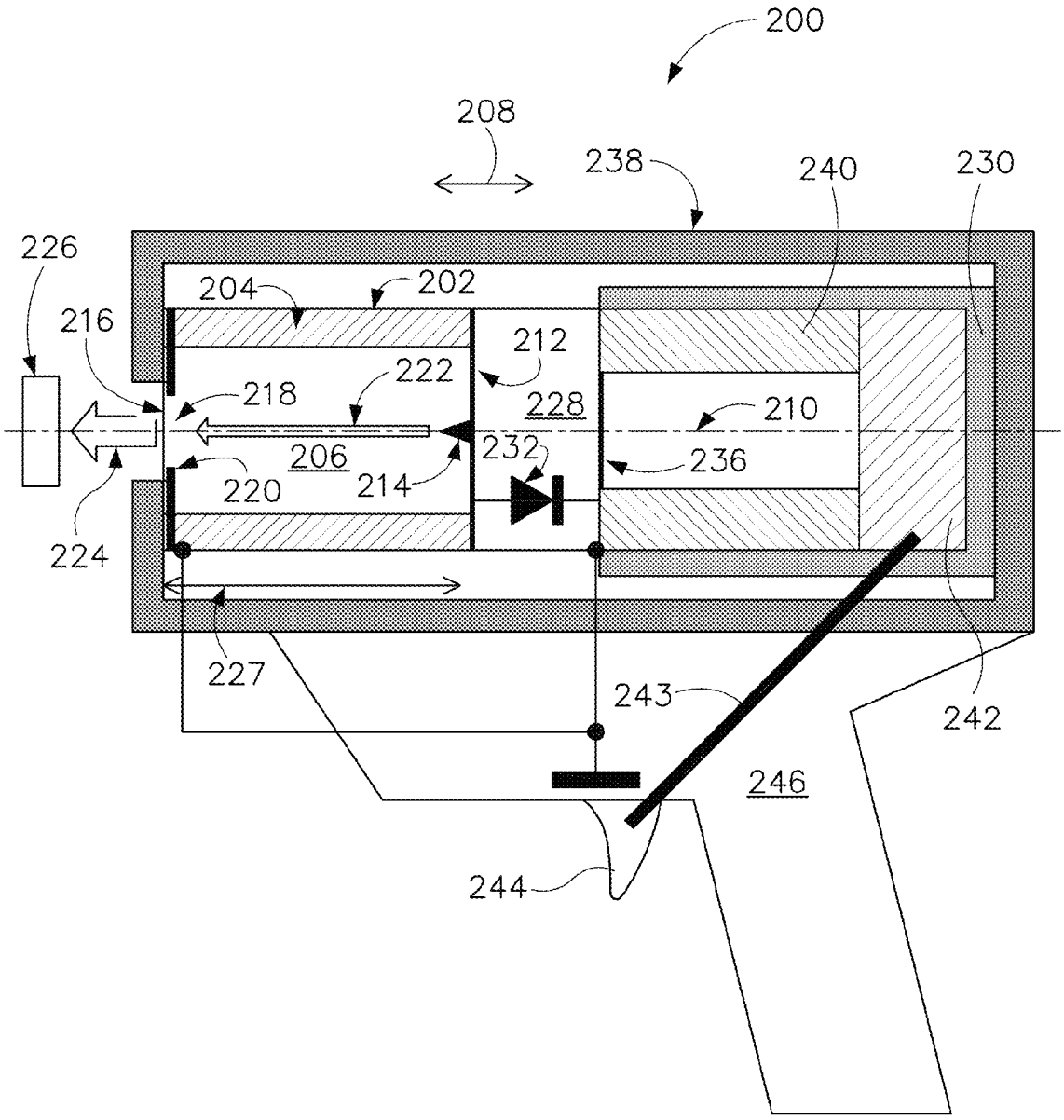

FIG. 3 is a side elevation view of an X-ray generator 200 in accordance with an example embodiment of the present disclosure. In the example embodiment, X-ray generator 200 includes an X-ray chamber 202 including a sidewall 204 that surrounds an evacuated volume 206. Sidewall 204 is formed of a piezoelectric material sensitive to a compressive force applied in an axial direction 208 along a longitudinal axis 210 of X-ray generator 200.

X-ray chamber 202 includes a cathode 212 enclosing a first end of X-ray chamber 202. A second opposite end of X-ray chamber 202 is enclosed by a window 216 having a target material 218 deposited thereon. An anode 220 is positioned within evacuated volume 206 adjacent window 216. A rigid outer shell 238 surrounds X-ray chamber 202, an insulator 228, and an actuator 230.

Actuator 230 includes a vibrator 240 and an energy storage device 242. In the example embodiment, vibrator 240 is a mechanical vibrator and energy storage device 242 is, for example, but not limited to a spring. The spring may be charged using a trigger 244, which is mechanically connected by a link 243 to energy storage device 242. In some embodiments, a single pull of trigger 244 charges and discharges energy storage device 242. In other embodiments, many pulls of trigger 244 are used to charge the spring until a predetermined amount of energy is stored. Energy storage device 242 is then discharged manually or automatically when the predetermined amount of energy is available. Vibrator 240 uses the stored energy to generate a series of vibrations or a single vibration or impulse, which is transmitted to sidewall 204 through insulator 228, cathode 212, and any other intervening components, such as, but not limited to a ground electrode (not shown in FIG. 2).

During operation, the vibrations or impulse is applied axially to sidewall 204. The compressive vibrations or impulse cause the piezoelectric material of sidewall 204 to generate an electrostatic charge proportional to a stress caused by the input force of the vibrations or impulse. The electrostatic charge accumulates on cathode 212 until the charge reaches a dielectric breakdown potential. A stream or burst of electrons 222 are then emitted from cathode 212 and are accelerated towards an anode 220. A large number of electrons 222 strike target material 218 with enough energy to generate X-rays 224, which continue outwardly from X-ray chamber 202 towards a sample material 226.

In various embodiments, actuator may be electrical such as a motor with an eccentric wheel to generate vibrations, in which case energy storage device 242 could be a battery, a supercapacitor, or other electrical storage device. In other embodiments, is a fluid-driven vibrator, in which case energy storage device 242 could be a store of compressed gas, for example, but not limited to a $CO_2$ cartridge. Moreover, in some embodiments, actuator 230 or parts of actuator 230, such as, vibrator 240 are formed around a radially outer surface of sidewall 204 and configured to impart a radially inward stress on sidewall 204 to generate liberate charge in the piezoelectric material.

A pistol grip 246 facilitates X-ray generator 200 being a hand-held device and generating a high voltage operating voltage onboard X-ray generator 200 using stored energy or energy applied by a human operator permits use in remote locations.

Figure 4:
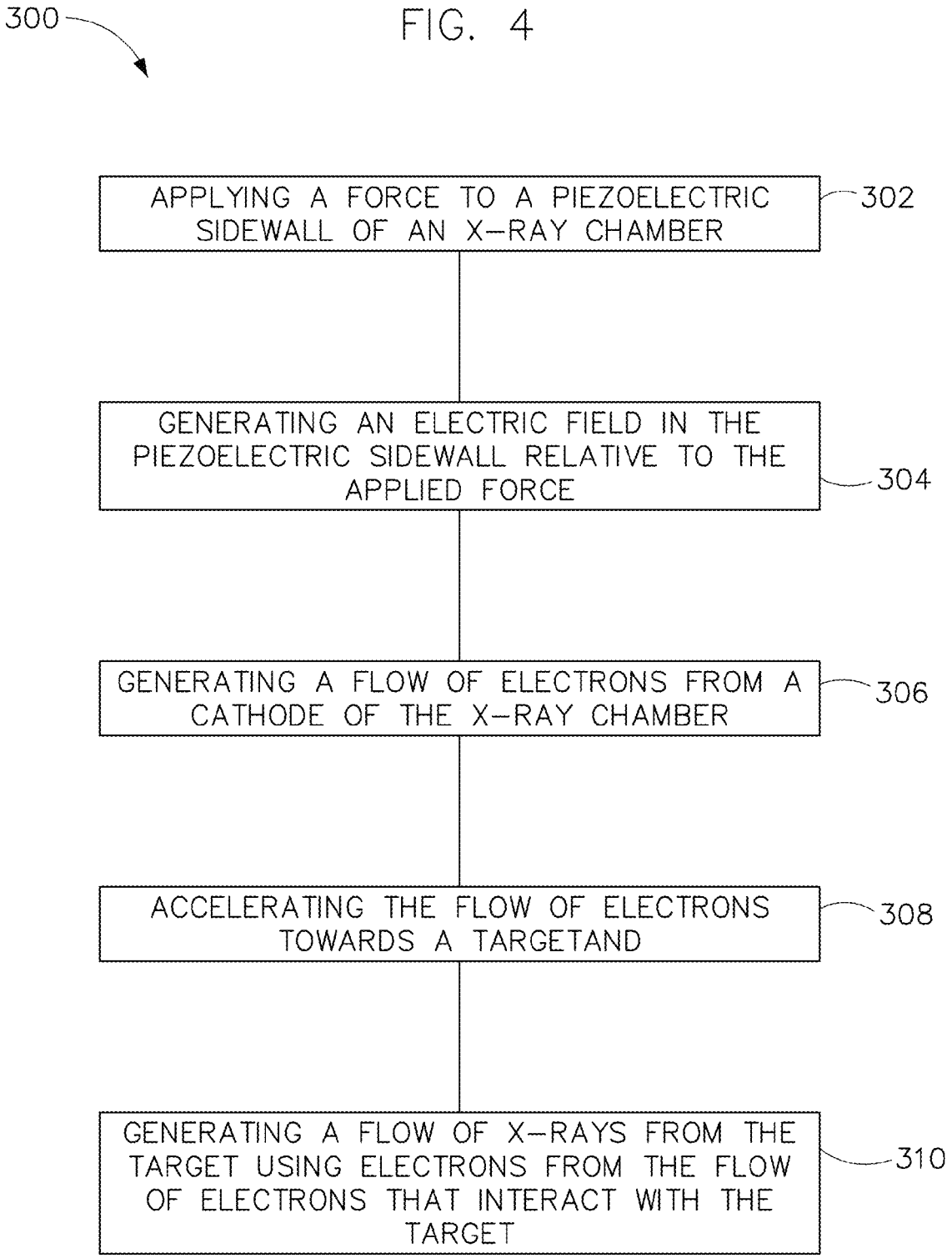

FIG. 4 is a flow diagram of a method 300 of generating a flow of X-rays. In the example embodiment, method 300 includes applying 302 a force to a piezoelectric sidewall of an X-ray chamber. In various embodiments, the force is applied using an actuator mechanically coupled to the sidewall. The force is applied axially or radially. Moreover, the force applied may be applied as a vibratory force occurring many times a second or may applied as an impulse force only one time with a relatively longer time between applications of the force. Method 300 further includes generating 304 an electric field in the piezoelectric sidewall relative to the applied force, and generating 306 a flow of electrons from a cathode of the X-ray chamber. Method 300 also includes accelerating 308 the flow of electrons towards a target, and generating 310 a flow of X-rays from the target using electrons from the flow of electrons that interact with the target.

Method 300 further includes storing energy in a hand-held housing surrounding at least a portion of the X-ray chamber. The X-ray chamber is configured to be housed in a hand-held device that is self contained to convert a force generated in the actuator into a stress in the sidewall, which in turn generates charge in the sidewall. In various embodiments, energy used to power the actuator is stored onboard the hand-held device. In some embodiments, the energy is stored as electrical energy in, for example, but, not limited to, batteries and/or supercapacitors. In other embodiments, the energy is stored as mechanical energy in, for example, a spring or compressed fluid. In an embodiment, the energy stored is generated by a human user by, for example, charging the spring or squeezing a trigger mechanism to pressurize a fluid.

The above-described embodiments of a method and system of generating X-rays using a hand-held X-ray generator provides a cost-effective and reliable means generating a stream of X-rays without external sources of energy or high voltage outside of the X-ray generator. More specifically, the methods and systems described herein facilitate generating a high voltage within an X-ray generating chamber. In addition, the above-described methods and systems facilitate providing an actuating force to the X-ray generating chamber from an actuator on-board the hand-held X-ray generator. As a result, the methods and systems described herein facilitate processes using X-rays in remote locations in a cost-effective and reliable manner.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An X-ray source comprising:

an X-ray chamber comprising:

a sidewall at least partially surrounding an evacuated chamber, said sidewall formed of a piezoelectric material;

a cathode positioned at a first end of the evacuated chamber;

an anode positioned at a second opposite end of the evacuated chamber; and a window positioned at the second end, the window substantially transparent to X-ray radiation, the window including a target material layer at least partially covering a surface of the window, the target layer configured to receive a flow of electrons from said cathode and to generate a flow of X-rays from an interaction with the flow of electrons; and an actuator coaxially aligned with said X-ray chamber and configured to generate a stress in said sidewall.

2. The X-ray source of claim 1, wherein said sidewall is configured to generate a voltage potential between said anode and said cathode according to:

$$E=L\cdot g_{33}\cdot\sigma,$$

where

E—Voltage potential between anode and cathode (V),

L—Piezoelectric Ceramic Length (m), g33—Piezoelectric material constant (V·m/N), and σ—Stress in Piezoelectric Ceramic ($N/m^2$).

3. The X-ray source of claim 1, wherein said actuator is configured to generate an axial stress in said sidewall of approximately $100\times10^6$ $N/m^2$.

4. The X-ray source of claim 1, wherein said actuator comprises a cylinder of piezoelectric material, said actuator configured to deflect axially in response to a received voltage, said actuator generating an axial force based on the deflection.

5. The X-ray source of claim 4, further comprising an electrical source coupled to said actuator, said electrical source configured to supply a voltage of approximately 150 Volts to approximately 200 Volts to the actuator.

6. The X-ray source of claim 4, further comprising an electrical source coupled to said actuator, said electrical source configured to supply a voltage at a frequency of approximately 800 Hz to approximately 20 kHz to the actuator.

7. The X-ray source of claim 4, further comprising an electrical source coupled to said actuator, said electrical source configured to supply a voltage at a frequency of approximately 500 Hz to approximately 30 kHz to the actuator.

8. The X-ray source of claim 4, further comprising an electrical source coupled to said actuator, said electrical source configured to supply a voltage at a frequency corresponding to a resonant frequency of approximately 500 Hz to approximately 30 kHz to the actuator.

9. The X-ray source of claim 1, wherein said actuator is configured to generate an axial force that is applied to the sidewall that coincides with a resonant frequency of the X-ray generator.

10. The X-ray source of claim 1, wherein said actuator comprises vibrating component comprising at least one of a mechanical vibrator, a fluid vibrator, a mechanical impulse generator, a fluid impulse generator.

11. The X-ray source of claim 1, further comprising an insulator extending between said X-ray chamber and said actuator, said insulator positioned adjacent to and abutting said cathode, said insulator positioned adjacent to and abutting a ground electrode, said insulator configured to transmit the axial force generated by the actuator to said piezoelectric sidewall.

12. A method of generating X-rays, said method comprising:

applying a force to a piezoelectric sidewall of an X-ray chamber;

generating a charge and potential of an electric field in the piezoelectric sidewall relative to the applied force;

generating an accelerated flow of electrons from a cathode of the X-ray chamber;

accelerating the flow of electrons towards a target; and generating a flow of X-rays from the target using electrons from the flow of electrons that interact with the target.

13. The method of claim 12, further comprising generating the force using an actuator mechanically coupled to the X-ray chamber.

14. The method of claim 12, further comprising storing energy in a hand-held housing surrounding at least a portion of the X-ray chamber.

15. The method of claim 14, wherein storing energy in a hand-held housing comprises storing energy generated by a human user in an energy storage device positioned within the hand-held housing.

16. The method of claim 12, wherein applying a force to a piezoelectric sidewall comprises applying at least one of an axial and a radial force to a piezoelectric sidewall.

17. The method of claim 12, wherein applying a force to a piezoelectric sidewall comprises applying at least one of a vibratory force and an impulse force to the piezoelectric sidewall.

18. The method of claim 12, generating a static electric field in the piezoelectric sidewall comprises generating an electric field in the piezoelectric sidewall in accordance with:

$$E=L\cdot g_{33}\cdot\sigma,$$

where

E—Voltage potential between anode and cathode (V),

L—Piezoelectric Ceramic Length (m), g33—Piezoelectric material constant (V·m/N), and σ—Stress in Piezoelectric Ceramic ($N/m^2$).

19. The method of claim 12, applying a force to a piezoelectric sidewall comprises applying a normal stress to a piezoelectric sidewall greater than approximately $100\times10^6 N/m^2$.

20. An X-ray generating system comprising:

a housing comprising a pistol-grip configured to receive a hand of a user;

an X-ray generator positioned at least partially within said housing, said X-ray generator comprising:

a sidewall formed of piezoelectric material, said sidewall configured to generate electric charge in response to a stress applied to said sidewall;

a cathode configured to concentrate the charge at a first end of said sidewall; and a target assembly positioned at a second opposite end of said sidewall, said target assembly comprising:

a target window;

a target material deposited on said target window; and an anode positioned adjacent said target window, said anode configured to accelerate a flow of electrons from said cathode toward said target material; and an actuator configured to generate a stress in the sidewall.

* * * * *